US005113852A

United States Patent [19]

Murtonen

[11] Patent Number: 5,113,852

[45] Date of Patent: May 19, 1992

[54] PROCEDURE AND DEVICE FOR APPLYING VIBRATION TO THE HUMAN BODY

[75] Inventor: Salomo Murtonen, Helsinki, Finland

[73] Assignee: Next Wave Inc., Kalamazoo, Mich.

[21] Appl. No.: 424,894

[22] Filed: Oct. 20, 1989

[30] Foreign Application Priority Data

Oct. 24, 1988 [FI] Finland ..... 884898

[51] Int. Cl.[5] ..... A61H 1/00

[52] U.S. Cl. ..... 128/33; 5/448

[58] Field of Search ..... 128/33, 34, 52, 36; 84/651, 660, 713, DIG. 12; 5/448, 508

[56] References Cited

U.S. PATENT DOCUMENTS

| | | | |
|---|---|---|---|
| 3,092,100 | 6/1963 | Oetinger | 128/33 |
| 3,556,088 | 1/1971 | Leonardini | 128/33 |
| 3,880,152 | 4/1975 | Nohmura | 128/33 |
| 4,023,566 | 5/1977 | Martinmaas | 128/33 |
| 4,154,232 | 5/1979 | Fukazawa | 128/52 |
| 4,630,519 | 12/1986 | Hirano et al. | 84/651 |
| 4,753,225 | 6/1988 | Vögel | 128/33 |
| 5,014,768 | 5/1991 | Raffel | 128/33 |

FOREIGN PATENT DOCUMENTS

| | | |
|---|---|---|
| 0251430 | 1/1988 | European Pat. Off. . |
| 3033598 | 4/1982 | Fed. Rep. of Germany . |
| WO8705497 | 3/1987 | PCT Int'l Appl. . |

*Primary Examiner*—Edgar S. Burr
*Assistant Examiner*—Moshe I. Cohen
*Attorney, Agent, or Firm*—Kane, Dalsimer, Sullivan, Kurucz, Levy, Eisele and Richard

[57] ABSTRACT

Procedure and device for applying vibration to the human body by means of vibrating elements. In the procedure, the vibrating elements are caused to vibrate in such manner that they generate intensity pulses and that the intensity pulses generated by different vibrating elements have a phase difference. The device comprises at least two vibrating elements which are caused to vibrate in such manner that they generate intensity pulses and that the intensity pulses generated by the vibrating elements have a phase difference.

15 Claims, 4 Drawing Sheets

PROCEDURE AND DEVICE FOR APPLYING VIBRATION TO THE HUMAN BODY

BACKGROUND OF THE INVENTION

The present invention relates to a procedure and a device for applying vibration to the human body by means of vibrating elements. In the procedure, to produce a pleasant feeling for the relaxation of the body, the vibrating elements are caused to vibrate at a low frequency, preferably in the range of 20–200 Hz, in such manner that they generate intensity pulses. The device for producing a pleasant feeling for the relaxation of the human body and/or for therapeutic treatment comprises at least two vibrating elements producing vibrations of a low frequency, preferably in the range of 20–200 Hz, in such manner that the vibrating elements generate intensity pulses.

In prior art, there are various methods and devices designed to stimulate different parts of the human organism, e.g. the skin, muscles or inner organs, and to produce a massaging effect by applying vibrations to the human body by means of vibrating elements. In many solutions of this category, it has been found advantageous to use low-frequency vibrations applied to the body by means of electromechanical vibrators or acoustic elements, e.g. loudspeakers. The vibrating elements, of which there are usually one or several, are mounted in a chair or resting support or equivalent on which the person to be treated can sit or lie down, so that the vibratory effect can be directed to the entire body or a part of it. The vibrating elements are preferably placed at a very close distance from the body so as to maximize the efficiency of transfer of the vibration.

International patent application publication WO 87/05497 proposes a device comprising one or more loudspeakers mounted in a suitable resting support. The loudspeakers supply low-frequency signals which are modulated and synchronized with music or a predetermined musical function.

German application publication DE 3 522 305 proposes a similar device, in which the signal fed into the vibrating elements consists of a combination of music and a rhythm signal produced by a rhythm synthesizer. In this device, the signal frequency and amplitude vary.

Furthermore, German application publication DE 3 541 350 and European application publication EP 0 251 430 propose devices which make use of the observation that different parts of the body can be treated most efficiently by altering the vibration frequency so as to match the resonant frequency of the relevant part of the body.

A drawback common to all the previously known solutions is that, by subjecting the body or a part of it to continuous vibration, whether of constant or varying frequency, they cause the part in question, e.g. muscles, to grow numb quite soon, so that the treatment will not produce the more lasting effects aimed at. Growing numb means that the organ in question becomes insensitive to the positive effects achievable by the application of vibration. A benumbed muscle will not relax unless it is allowed to rest and be restored.

The object of the present invention is to eliminate the drawbacks mentioned above.

A further object of the invention is to achieve a procedure and a device designed to give the person under treatment a pleasant feeling of well-being and produce a comprehensive state of relaxation.

An additional object of the invention is to provide, e.g. for sportsmen, a possibility for quick restoration of muscles.

To achieve these objects, in the procedure and device of the invention for applying vibration to the human body the intensity pulses generated by different vibrating elements have a phase difference.

SUMMARY OF THE INVENTION

The invention is based on the important observation that the massaging and relaxing effects produced by subjecting the body or parts of it to vibration are significantly enhanced if the vibration itself is subject to continuous and diverse variation, i.e. if the vibration undergoes cyclic decreases and increases of intensity, generating intensity pulses produced by the vibrating elements, and if these intensity pulses are separated by a phase difference between them so that the massaging action is directed successively to different parts of the body, the vibrated parts being allowed a moment of rest and restoration after each pulse. A specific advantage is gained by using an arrangement where the intensity pulses produced by adjacent vibrating elements reach their maximum values successively. This produces a particularly pleasant massaging effect which feels like a wave that rolls along the body or the part being treated.

In an embodiment of the invention, the frequency of the vibration produced by each vibrating element can be varied within a certain range, so that each part of the body will receive vibration of a frequency corresponding to its own resonant frequency. If a resting support, a chair or the like is provided with vibrating elements as described above and the elements are arranged over the whole length of the body, and if the vibrating elements are caused to vibrate in such a way that the intensity pulses produced by them occur with a phase difference between them, then, if the phase difference is suitable and the intensity pulses occur successively in adjacent vibrating elements, a continuously repeated rotary effect advancing in a wavelike manner as mentioned above is achieved. This rotary effect can be continuously repeated, its direction of advance can be changed, it can be applied to various parts of the body as desired, and the rotary motion can be accelerated and decelerated. By having at least one of the elements vibrate at a frequency corresponding to music frequency, the device of the invention can be used to produce desired effects, e.g. therapeutic effects, on the person being treated.

The device of the invention for applying vibration to the human body comprises at least two vibrating elements, whose vibration is so implemented that intensity pulses are produced. The vibration of the elements is so controlled that the intensity pulses produced by different elements are separated from each other by a phase difference. The optimal rotary effect referred to above is achieved if the device comprises at least three vibrating elements. In this case a feeling of wavelike advance of the vibration is created.

The best advantages offered by the procedure and device can be realized if the device is provided with a controlling and regulating means allowing diverse adjustment and/or programming. This controller-regulator can control the phase difference referred to, the frequency of occurrence of the intensity pulses, the frequency of vibration or the limits of the frequency ranges, the amplitude of the vibration produced by each vibrating element, or the total amplitude of the vibration produced by all the vibrating elements.

DETAILED DESCRIPTION OF THE DRAWINGS

Figure 1:
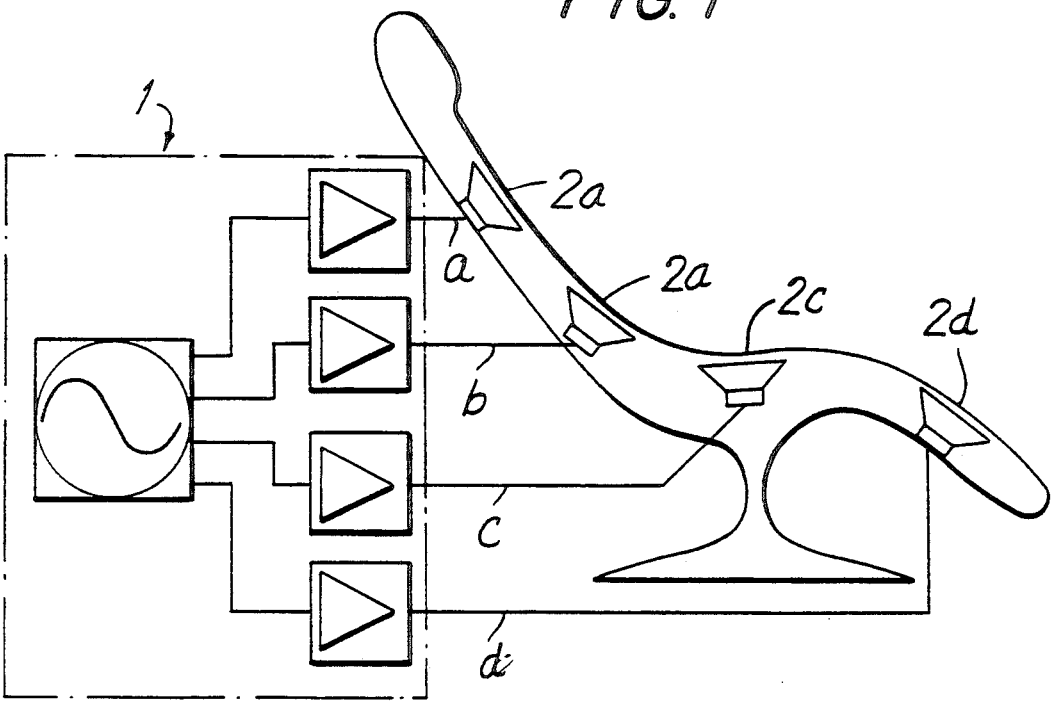
Figure 2:
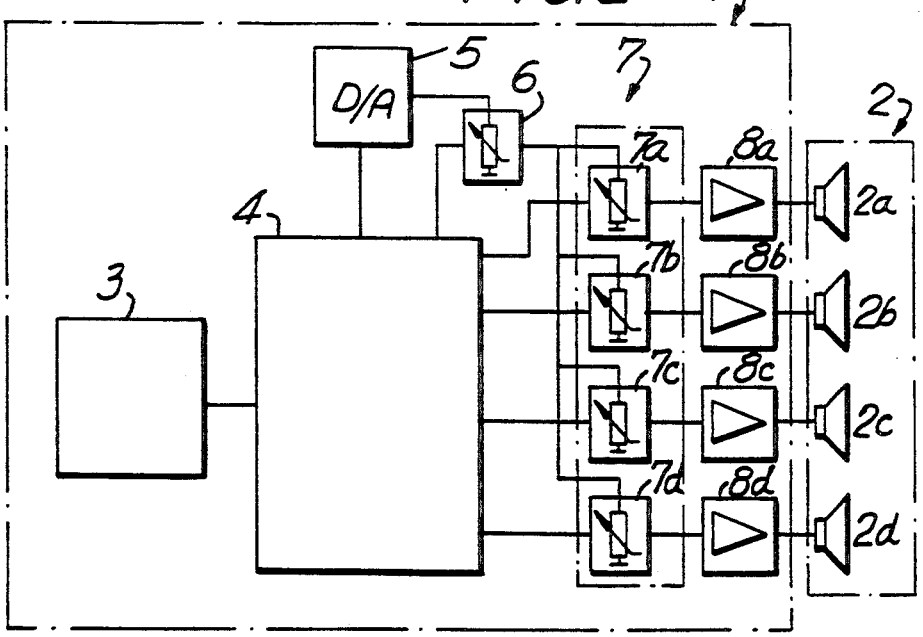
Figure 3:
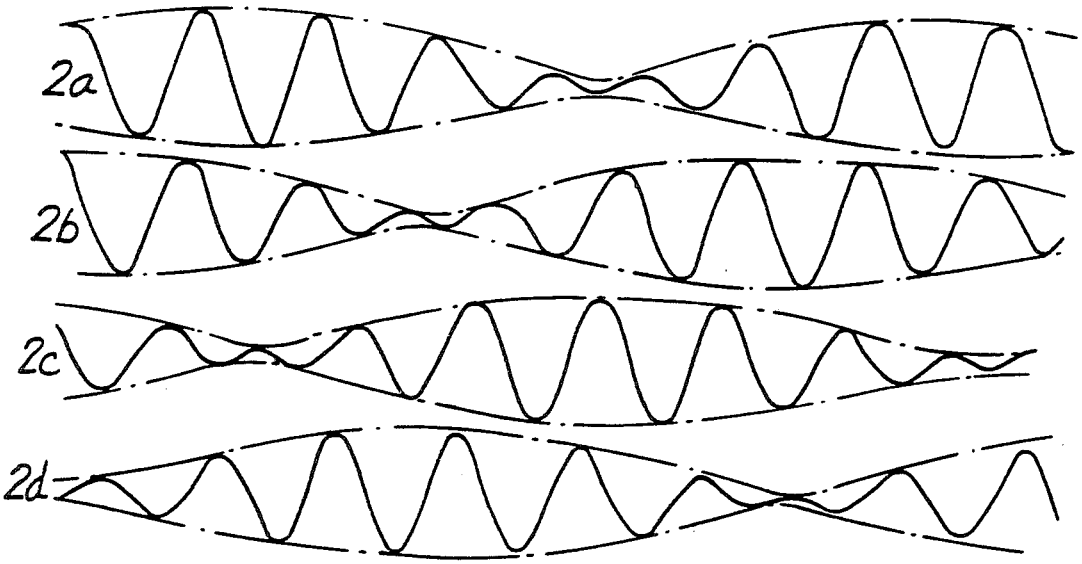
Figure 4:
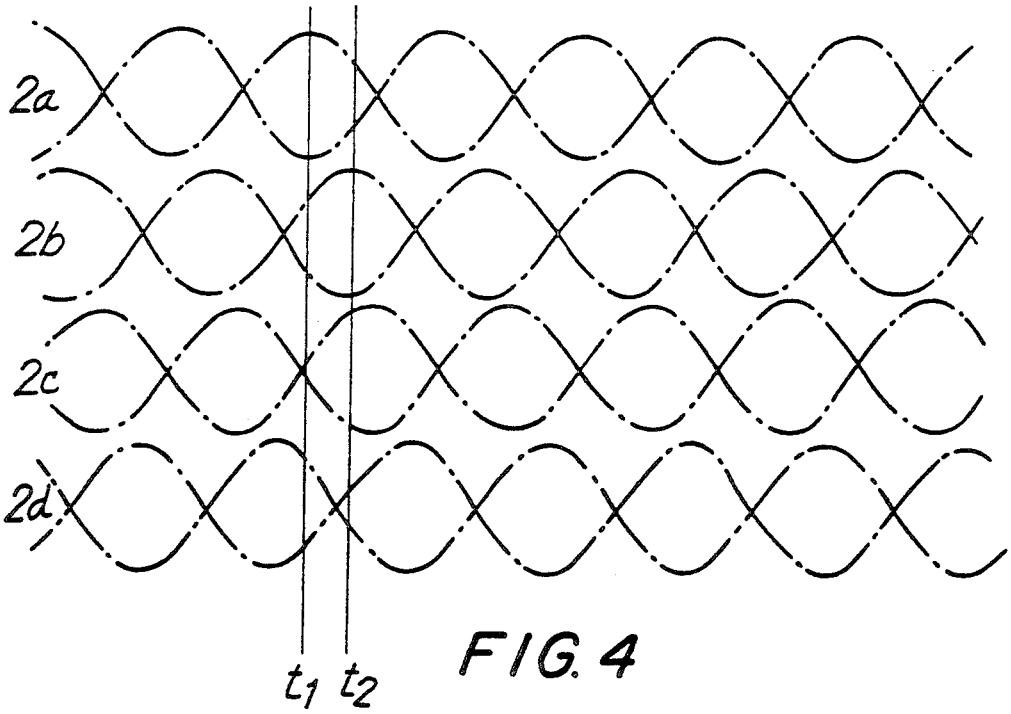
Figure 4A:
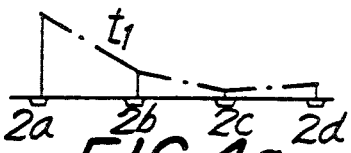
Figure 4B:
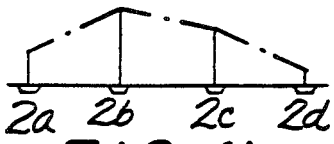
Figure 5:
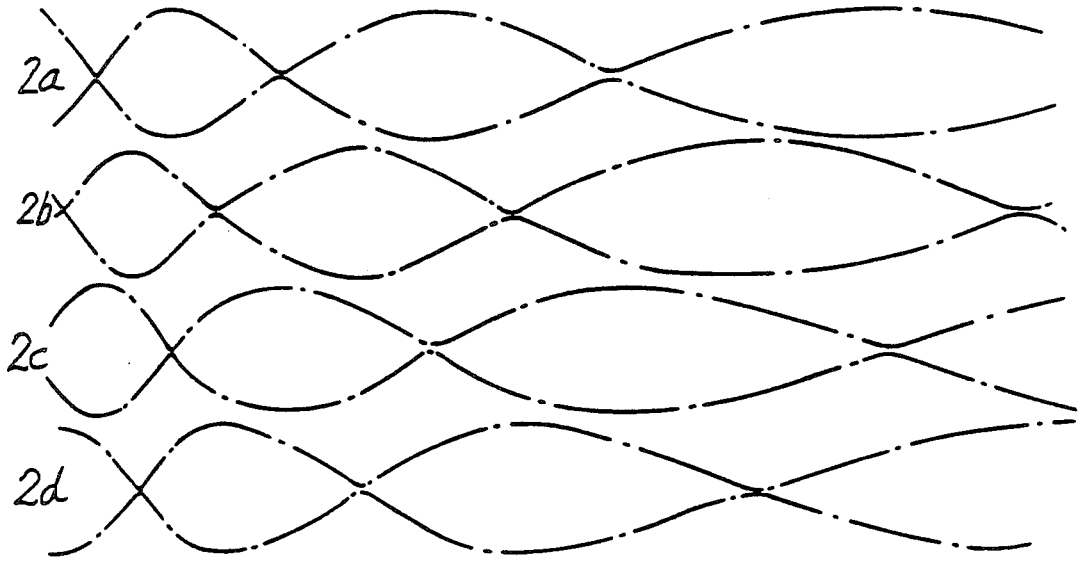
Figure 6:
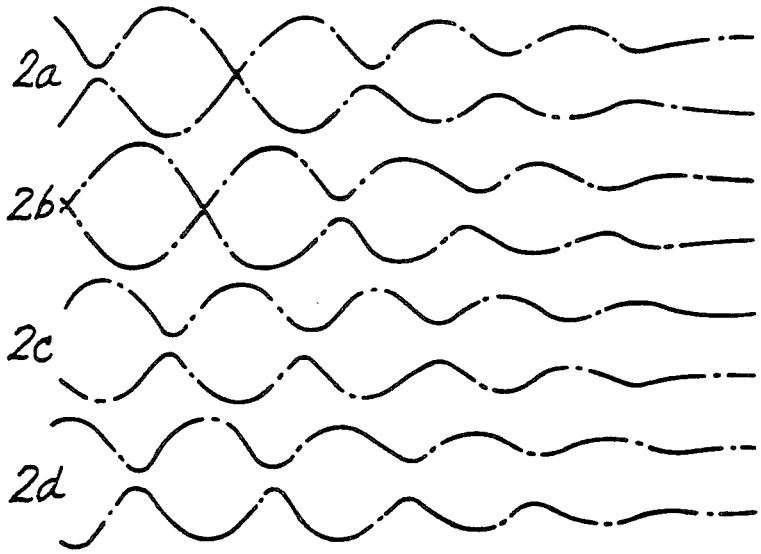

In the following, the invention is described in detail with reference to the appended drawing, in which FIG. 1 presents a diagram representing an embodiment of the device of the invention;

FIG. 2 presents a diagram representing another embodiment of the device of the invention;

FIG. 3 presents a diagram representing the intensity pulses produced by different vibrating elements in an embodiment of the procedure of the invention in a given situation occurring in the procedure;

FIG. 4 presents the arrangement of the intensity pulses produced by different vibrating elements in an embodiment of the procedure of the invention in a given situation occurring in the procedure;

FIG. 4*a* presents a bar diagram representing the relative intensities of the vibrations produced by vibrating elements 2*a*–2*d* at instant t1;

FIG. 4*b* presents a bar diagram representing the relative intensities of the vibrations produced by vibrating elements 2*a*–2*d* at instant t2;

FIG. 5 presents a situation occurring in an embodiment of the procedure of the invention where the frequency of the intensity pulses produced by different vibrating elements is being changed; and FIG. 6 presents a certain situation occurring in an embodiment of the procedure of the invention where the amplitude of the intensity pulses produced by different vibrating elements is being changed.

Figure 7:
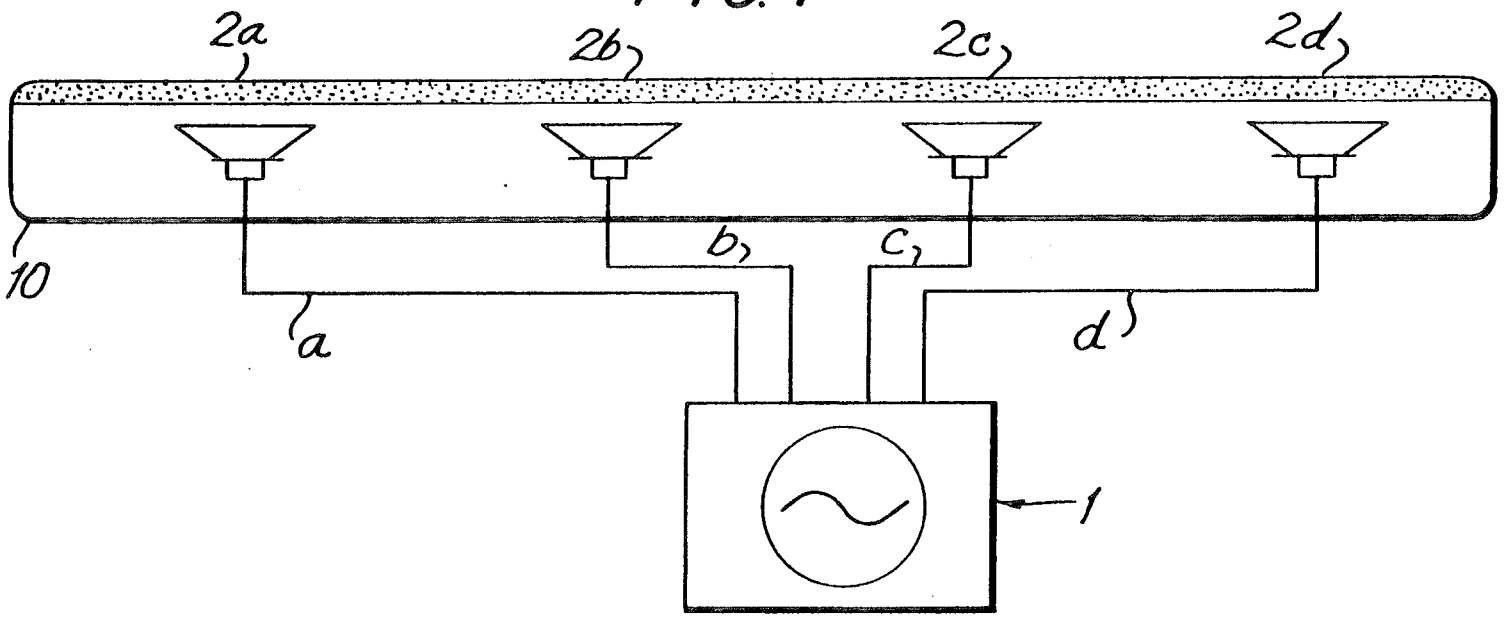

FIG. 7 presents a diagram representing a further embodiment of the device of the invention, wherein the support structure is a mattress.

DESCRIPTION OF THE PREFERRED EMBODIMENT

FIG. 1 shows a diagram representing an embodiment of the device of the invention, which can be used to implement the procedure of the invention for applying vibration to the human body by means of vibrating elements 2, in which procedure the vibrating elements are caused to vibrate at a low frequency, preferably in the range of 20–200 Hz, in such manner that they generate intensity pulses and that these pulses have a phase difference between them. The vibrating elements are placed in an easy chair at suitable distances from each other. The figure shows only four vibrating elements, but obviously there can be any suitable number of them, yet at least two. The vibrating elements can be placed side by side, contiguously or in any other suitable way. Since the vibrations in question are in the audio frequency range (20–200 Hz and/or music frequency), loudspeakers can be used as vibrating elements. The loudspeakers are preferably placed very close to that surface of the easy chair which faces the body resting on it, so that the vibrations will be transferred unimpeded to the body. The layout of the loudspeakers 2 in the easy chair can be e.g. as shown in the figure, with one speaker 2*a* placed in the back of the chair in the region of the shoulders, one speaker 2*b* in the back at waist level, one speaker 2*c* in the seat in the region of the buttocks and one speaker 2*d* in the leg support in the region of the thighs. It is naturally possible to mount several loudspeakers side by side. This might be desirable e.g. in the regions of the shoulders and the thighs. The loudspeakers can be arranged in different channels a, b, c, d to allow individual control, each channel corresponding to one loudspeaker or group of loudspeakers placed side by side, each channel being controlled by a controlling and regulating means 1.

An arrangement like this, allowing individual control of the vibrating elements, is essential to the implementation of the procedure. Individual control of the vibrating elements can also be implemented in any other suitable way.

The device of the invention comprises a controller-regulator 1, which is designed to provide maximal versatility in respect of adjustability of the system. The controller-regulator 1 generates low-frequency oscillation in the frequency range of 20–200 Hz, a suitable range being 25–150 Hz and a preferable range 30–100 Hz. The oscillation preferably consists of a sine wave, which is the simplest waveform. The amplitude of the sine waves produced by the controller-regulator 1 is varied so that the vibration is intensified and damped in a cyclical fashion, thus producing cyclically varying pulses, hereinafter referred to as intensity pulses. The vibrating elements are individually controllable e.g. via channels a, b, c, d, making it possible to produce a phase difference as provided by the invention between the intensity pulses generated by different vibrating elements 2. The phase difference between the intensity pulses produced by two different vibrating elements refers to the interval of time between the occurrence of the peak values of the intensities of the vibrations produced by the two vibrating elements. The phase difference is described in greater detail in connection with FIGS. 4, 4*a* and 4*b*.

By means of the controller-regulator 1, it is possible to increase or decrease the phase difference between the intensity pulses and adjust the frequency of occurrence and/or oscillation of the intensity pulses produced by different vibrating elements 2, or to change the limits within which the frequency can be varied. The controller-regulator can also adjust the amplitude or strength of the vibration generated by each vibrating element 2 and/or the total amplitude of the vibration generated by the vibrating elements 2, i.e. the overall strength of vibration of the system. Obviously the controller-regulator 1 can be constructed in any manner suited for implementing the idea of the invention. Thus the controlling and regulating functions can be implemented by manual control, by program control, by digital or analog techniques or in any other suitable way.

In the embodiment in FIG. 2, the controller-regulator 1 consists of a regulating unit 3 and a control unit 4, which are arranged to adjust the phase difference between the intensity pulses produced by different vibrating elements and/or the frequency or frequency range of the vibration generated by each vibrating element. The control unit 4 may be e.g. a microprocessor which produces the vibrations in digital form. The vibration signal is passed to a digital-to-analog converter 5, which converts the digital vibration signal into analog vibration. From the DAC, the vibration signal is passed to a unit 6 controlling the overall amplitude or strength of the vibration signal applied to the vibrating elements 2. This overall amplitude control unit 6 may be e.g. a digitally controlled potentiometer. The controller-regulator 1 also comprises a so-called rotary-effect unit 7, which has a separate amplitude control unit 7*a*, 7*b*, 7*c*, 7*d* for each vibrating element. These control units, too, may be digitally controlled potentiometers and are controlled by the regulating unit 3 and/or the control unit 4. In this embodiment there is a power amplifier 8*a*–8*d* for each speaker unit 2*a*–2*d*. Controlled by the regulating unit 3 or control unit 4, the rotary-effect unit 7 can vary the frequency of occurrence of the intensity pulses of different vibrating elements. It can also vary the amplitude of the vibration produced by each vibrating element.

The diagram in FIG. 3 corresponds to the device illustrated by FIG. 1, comprising four vibrating elements 2*a*–2*d* vibrating as illustrated in FIG. 3. The reference numbers 2*a*–2*d* correspond to the vibrating elements 2*a*–2*d* in FIG. 1 or FIG. 2. The figure is a clear illustration of the way in which the amplitude of the sinusoidal vibration is varied. The dotted broken line in the figure represents the envelope of the vibration. The intensity pulses consist of this kind of vibration periods with increasing and decreasing amplitude. The figure also clearly shows the phase difference between the intensity pulses consisting of the vibrations produced by different vibrating elements in a certain situation in the procedure of the invention.

FIG. 4 shows an arrangement corresponding to FIG. 3, with the difference that the frequency of occurrence of the intensity pulses is higher than in the situation in FIG. 3. The figure clearly illustrates the embodiment of the procedure of the invention in which the intensity pulses generated by adjacent vibrating elements are separated by a phase difference and are so arranged that the maximum values of the intensity pulses in adjacent vibrating elements occur in succession. Let us consider the situation at instant t1. At instant t1, the intensity pulse generated by vibrating element 2*a* is at its maximum value. At instant t1, the amplitude of the vibration generated by element 2*b* is lower than that of the vibration generated by element 2*a*. Likewise, at instant t1, the amplitude of the vibration generated by element 2*c* is lower than that of the vibration generated by element 2*b*. At instant t1, the amplitude of the vibration generated by element 2*d* is lower than that of the vibration generated by element 2*c*. Thus, at instant t1, 2*a* is at a maximum, 2*b* and 2*c* are increasing and 2*d* decreasing in amplitude. The time interval t1–t2 is the phase difference between the intensity pulses produced by vibrating elements 2*a* and 2*b*. At instant t2, the amplitude of the vibration of element 2*a* is lower than at instant t1. The amplitude of the vibration of element 2*b* has reached its maximum value. The amplitude of the vibration of element 2*c* is lower than the amplitude of the vibration of element 2*b*, and the amplitude of the vibration of element 2*d* is lower than the amplitude of the vibration of element 2*c*.

The bar diagram in FIG. 4*a* represents the relative amplitudes of the vibrations produced by elements 2*a*–2*d* at instant t1, corresponding to FIG. 4.

FIG. 4*b* shows a corresponding diagram for instant t2.

By arranging the vibration intensity pulses in the manner illustrated by FIGS. 4, 4*a* and 4*b* e.g. in an embodiment implemented as shown in FIG. 1, a rolling massaging effect advancing in a wavelike manner e.g. from the upper part to the lower part of the body is achieved. This provides the advantage that the organs of the body which have been subjected to vibration are allowed some time for restoration between the pulses. The phase difference between the intensity pulses of adjacent vibrating elements is in the range of 0.1–5 s, suitably 0.2–4 s and preferably 0.3–3 s.

FIG. 5 illustrates a situation occurring in an embodiment of the procedure of the invention where the frequency of the intensity pulses produced by different vibrating elements is being changed. In this situation, a regulating action retarding the rotary effect is performed.

FIG. 6 illustrates a certain situation occurring in an embodiment of the procedure of the invention where the amplitude of the intensity pulses produced by the vibrating elements, the total amplitude of the system as a whole as well as the shape of the intensity pulses are changed. In other words, in the situation represented by the curves on the right-hand side of the figure, no rotary effect is present.

Within the scope of the invention, it is possible to achieve a massaging program that permits a very large variety of adjustments and, if desirable, can be freely preprogrammed, a program that lives within the whole range of its adjustability and permits any desired variation of any of its parameters. Although the above examples present the procedure and device of the invention as an application involving the use of an easy chair, the invention can equally well be implemented using a mattress, a seat or a similar support. The device of the invention can also be implemented without using any resting support at all, in which case the person to be treated will e.g. stand and receive the vibrations from elements placed separately at different locations on the body.

For example, FIG. 7 shows the device of the invention incorporated into a mattress 10, instead of an easy chair or seat.

The invention is not restricted to the examples of its embodiments described above but allows many variations within the scope of the idea of the invention as defined in the claims.

What we claim is:

1. Procedure for applying vibration acoustically to the human body by means of vibrating elements to produce a pleasant feeling for the relaxation of the body comprising:

providing a plurality of vibrating elements, each of said plurality of vibrating elements being vibrated at an audio frequency in the range from 20 Hz to 200 Hz, arranging said plurality of vibrating elements in a substantially linear array, so that each of said plurality of vibrating elements may be adjacent to a specific region of a human body disposed in close proximity to said substantially linear array; and cyclically and continuously varying the intensity of vibration of each of said plurality of vibrating elements periodically between maximum and minimum values other than zero to generate intensity maxima at a predetermined frequency of occurrence, generating each of said plurality of vibrating elements at different times by providing a phase difference between the intensity maxima generated by adjacent ones of said plurality of vibrating elements, so that the intensity maxima may occur successively in adjacent ones of said plurality of vibrating elements along said substantially linear array to produce the sensation of a wave travelling along a human body disposed in close proximity to said substantially linear array.

2. Procedure according to claim 1, wherein the phase difference between the intensity maxima of adjacent vibrating elements is in the range of 0.1–5 s.

3. Procedure according to claim 1, wherein the frequency of the vibration generated by each vibrating element is varied within said range of frequencies.

4. Procedure according to claim 1, wherein the frequency of occurrence of the intensity maxima of all vibrating elements is changed simultaneously.

5. Procedure according to claim 1, wherein at least one of the vibrating elements is caused to vibrate at a frequency corresponding to music frequency.

6. Device for applying vibration acoustically to the human body by means of vibrating elements to produce a pleasant feeling for the relaxation of the body and/or for therapeutic treatment, said device comprising:

a support structure;

a plurality of vibrating elements, each of said plurality of vibrating elements being vibrated at an audio frequency in the range from 20 Hz to 200 Hz, said plurality of vibrating elements being arranged in a substantially linear array within said support structure;

means for setting the frequency of vibration of each of said plurality of vibrating elements;

means for controlling the intensity of vibration of each of said plurality of vibrating elements and the total intensity of the vibration produced by said plurality of vibrating elements;

means for cyclically and continuously varying the intensity of vibration of each of said plurality of vibrating periodically elements between maximum and minimum values other than zero to generate intensity maxima at a predetermined frequency of occurrence;

means for predetermining the frequency of occurrence of said intensity maxima in the intensity of vibration of each of said plurality of vibrating elements; and means for setting the phase difference separating the occurrence of the intensity maxima generated by adjacent ones of said plurality of vibrating elements.

7. Device according to claim 6, wherein said means for setting the phase difference separating the occurrence of the intensity maxima generated by different vibrating elements is a controller-regulator.

8. Device according to claim 6, wherein said means for setting the frequency of the vibration generated by the vibrating elements is a controller-regulator.

9. Device according to claim 6, wherein said means for predetermining the frequency of occurrence of the intensity maxima generated by each vibrating element is a controller-regulator provided with a rotary-effect unit.

10. Device according to claim 9, wherein the rotary-effect unit is provided with means for controlling the amplitude of the vibration generated by each vibrating element.

11. Device as claimed in claim 6, wherein said means for cyclically and continuously varying the intensity of vibration of each of said plurality of vibrating elements is a controller-regulator.

12. Device as claimed in claim 6, wherein said means for controlling the intensity of vibration of each of said plurality of vibrating elements and the total intensity of the vibration produced by said plurality of vibrating elements is a controller-regulator.

13. Device according to claim 11, wherein said controller-regulator is provided with an intensity-regulating unit for regulating the overall intensity of the vibration generated by said plurality of vibrating elements.

14. Device as claimed in claim 9, wherein said support structure is a mattress.

15. Device as claimed in claim 6, wherein said support structure is an easy chair.

* * * * *